US011060786B1

(12) United States Patent
Des Champs

(10) Patent No.: US 11,060,786 B1
(45) Date of Patent: Jul. 13, 2021

(54) SYSTEMS, DEVICES, AND/OR METHODS FOR MANAGING CONDENSATE

(71) Applicant: Nicholas Howard Des Champs, Fincastle, VA (US)

(72) Inventor: Nicholas Howard Des Champs, Fincastle, VA (US)

( * ) Notice: Subject to any disclaimer, the term of this patent is extended or adjusted under 35 U.S.C. 154(b) by 0 days.

(21) Appl. No.: 16/902,410

(22) Filed: Jun. 16, 2020

Related U.S. Application Data

(60) Provisional application No. 63/025,541, filed on May 15, 2020, provisional application No. 62/914,589, filed on Oct. 14, 2019.

(51) Int. Cl.
*F25D 21/14* (2006.01)

(52) U.S. Cl.
CPC ..... *F25D 21/14* (2013.01)

(58) Field of Classification Search
CPC ... F25D 21/14; F24F 13/222; F24F 2013/227; F24F 2140/30
See application file for complete search history.

(56) References Cited

U.S. PATENT DOCUMENTS

| | | | | |
|---|---|---|---|---|
| 1,363,732 A | | 12/1920 | Heidmann | |
| 1,549,566 A | | 8/1926 | Bain | |
| 1,709,678 A | | 4/1929 | Miller | |
| 2,117,056 A | | 5/1938 | Dunn | |
| 2,277,647 A | | 3/1942 | Jones | |
| 2,760,596 A | | 8/1956 | Kellie | |
| 3,799,186 A | | 3/1974 | Bulin | |
| 4,007,759 A | | 2/1977 | Martin | |
| 4,475,569 A | | 10/1984 | Foller | |
| 4,527,584 A | | 7/1985 | Miller | |
| 4,627,460 A | | 12/1986 | Eising | |
| 4,722,744 A | | 2/1988 | Stoll | |
| 4,742,842 A | | 5/1988 | Garneau | |
| 4,856,550 A | | 8/1989 | Smelcer | |
| 4,918,935 A | * | 4/1990 | Trent | F24F 3/14 62/285 |
| 5,080,126 A | | 1/1992 | De Rycke | |
| 5,115,798 A | | 5/1992 | Moore | |
| 5,201,340 A | | 4/1993 | Teepe | |

(Continued)

FOREIGN PATENT DOCUMENTS

| | | |
|---|---|---|
| AU | 2016420053 | 3/2020 |
| CA | 3029390 | 9/2020 |

(Continued)

OTHER PUBLICATIONS

"Carrier Condensate trap", Jan. 30, 2018, 1 page, https://www.zoro.com/carrier-condensate-trap-319830-402/i/G5562280.

(Continued)

*Primary Examiner* — Elizabeth J Martin
(74) *Attorney, Agent, or Firm* — Michael Haynes PLC; Michael N. Haynes

(57) ABSTRACT

A system, machine, device, and/or manufacture configured to operatively trap air and/or release condensate after operatively lifting the condensate from a condensate drain pan located inside a housing of a condensate-producing unit, the condensate drain pan configured to collect condensate from a cooling coil of the condensate-producing unit, an air mover of the condensate-producing unit located fluidically downstream of the cooling coil.

19 Claims, 6 Drawing Sheets

(56) References Cited

U.S. PATENT DOCUMENTS

| | | | | |
|---|---|---|---|---|
| 5,341,653 | A * | 8/1994 | Tippmann | F25D 11/003 62/280 |
| 5,348,041 | A | 9/1994 | Clark | |
| 5,379,749 | A | 1/1995 | Rieke | |
| 5,582,159 | A | 12/1996 | Harvey | |
| 5,644,925 | A | 7/1997 | Chaves | |
| 5,644,935 | A | 7/1997 | Chaves | |
| 5,704,343 | A | 1/1998 | Ahn | |
| 5,797,426 | A | 8/1998 | Powell | |
| 6,009,898 | A | 1/2000 | Risch | |
| 6,302,136 | B1 | 10/2001 | Weaver | |
| 6,698,225 | B2 | 3/2004 | Chaves | |
| 6,823,885 | B2 | 11/2004 | Hotta | |
| 6,895,771 | B1 | 5/2005 | Cantolino | |
| 6,931,882 | B1 | 8/2005 | Yang | |
| 7,389,651 | B2 | 6/2008 | Cantolino | |
| 7,578,932 | B2 | 8/2009 | Cantolino | |
| 7,854,238 | B2 | 12/2010 | Zatarain | |
| 8,056,553 | B2 | 11/2011 | Khan | |
| 8,555,915 | B2 | 10/2013 | Brunner | |
| 9,777,957 | B1 | 10/2017 | Des Champs | |
| 10,488,088 | B2 | 11/2019 | Verma | |
| 10,603,605 | B1 | 3/2020 | Mills | |
| 10,605,480 | B1 | 3/2020 | Des Champs | |
| 10,712,044 | B1 | 7/2020 | Des Champs | |
| 10,731,772 | B2 | 8/2020 | Czyszczon | |
| 10,775,073 | B2 | 9/2020 | Des Champs | |
| 10,837,672 | B1 | 11/2020 | Des Champs | |
| 2003/0037561 | A1 | 2/2003 | Chaves | |
| 2003/0098061 | A1 | 5/2003 | Stuchlik, II | |
| 2005/0155535 | A1 | 7/2005 | Rieke | |
| 2008/0099083 | A1 | 5/2008 | Nishimoto | |
| 2009/0229539 | A1 | 9/2009 | Young | |
| 2011/0174202 | A1 | 7/2011 | Gedcke | |
| 2011/0174461 | A1 | 7/2011 | Kowald | |
| 2013/0306163 | A1 | 11/2013 | Hubbard | |
| 2019/0226715 | A1 * | 7/2019 | Des Champs | F16T 1/22 |

FOREIGN PATENT DOCUMENTS

| | | |
|---|---|---|
| DE | 827066 | 1/1952 |
| EP | 3338033 | 2/2020 |
| GB | 2479772 | 10/2011 |
| WO | WO18/034636 | 2/2018 |

OTHER PUBLICATIONS

"Lennox Condensate Drain Trap", Jan. 30, 2018, 1 page, https://www.zoro.com/lennox-condensate-drain-trap-61m35/i/G5560628.
U.S. Appl. No. 62/914,589, Des Champs, filed Oct. 14, 2019.
U.S. Appl. No. 63/025,541, Des Champs, filed May 14, 2020.
U.S. Appl. No. 16/902,410, Des Champs, filed Jun. 16, 2020.
Dura Plastic Products, Inc., "UVR Fittings", Jan. 1, 2021, 12 pages, http://www.duraplastics.com/userfiles/file/assets/files1/uvr-fittings-8015.pdf.

* cited by examiner

SYSTEMS, DEVICES, AND/OR METHODS FOR MANAGING CONDENSATE

CROSS-REFERENCES TO RELATED APPLICATIONS

This application claims priority to, and incorporates by reference herein in its entirety, and most particularly for their discussion of novel condensate traps and air-traps, the following documents:

U.S. Provisional Patent Application 63/025,541, filed 15 May 2020;

U.S. Provisional Patent Application 62/914,589, filed 14 Oct. 2019;

PCT Patent Application WO2018034636;

United States Patent Application Publication 20190226715;

U.S. Pat. No. 9,777,957; and

U.S. Pat. No. 10,591,185.

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which.

DESCRIPTION

Figure 1:
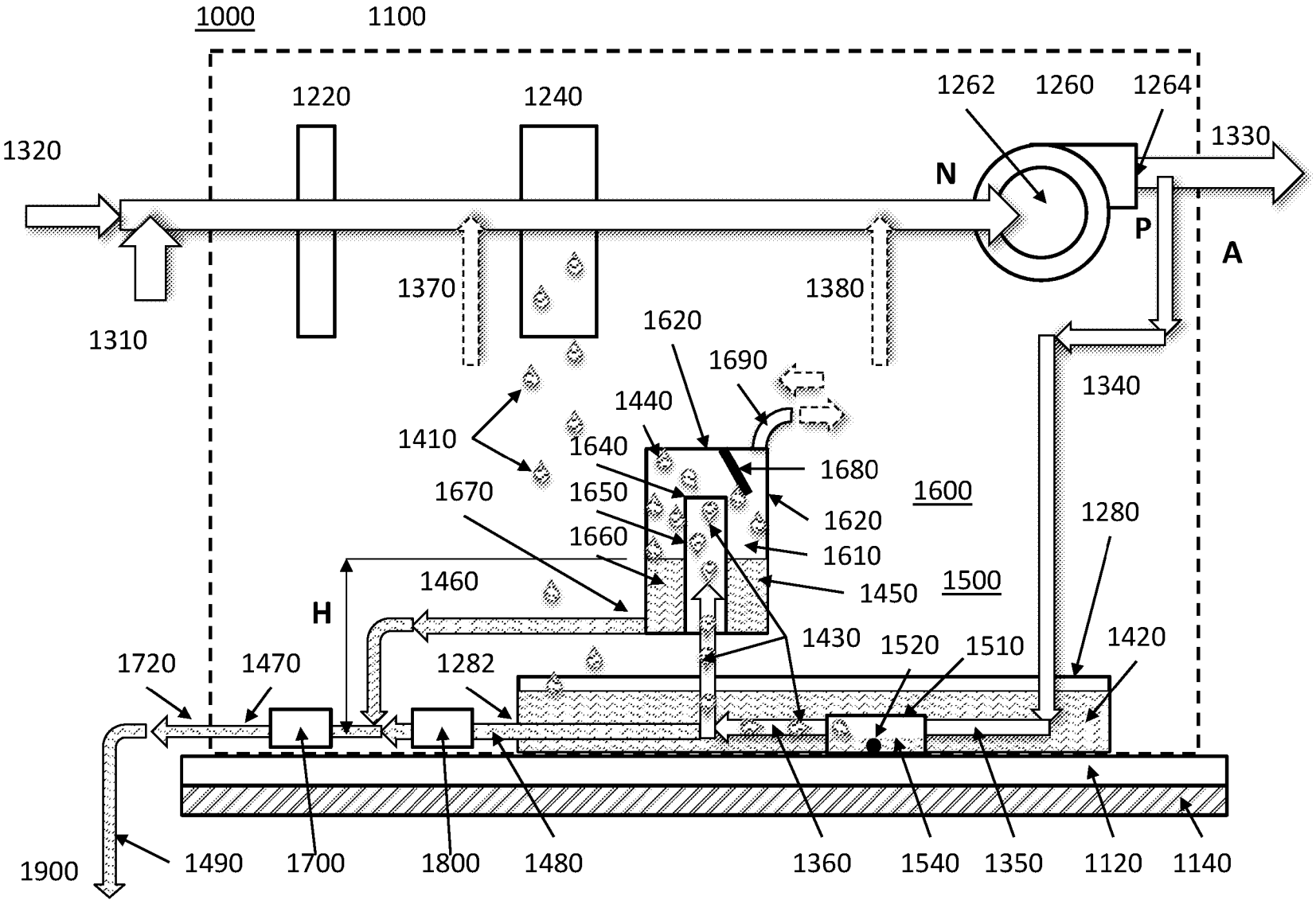
FIG. 1 is a flow diagram of an exemplary embodiment of a system 1000.

Certain exemplary embodiments relate to the technical field of heating, ventilating, and air conditioning ("HVAC") and can involve condensate management systems that utilize "traps" that allow condensate to drain from a condensate source, such as an HVAC, air conditioning, ice-making, dehumidifying, and/or other condensate-producing unit, equipment, and/or system, and that simultaneously prevent air from entering or escaping from the unit via the condensate drain.

As an example, certain exemplary embodiments can be associated with, e.g., a rooftop condensate-producing unit that has a cooling coil to cool a gas, such as air moving to and/or within a building, including within ductwork in the building. Note that as used herein, "air" need not be pure air, but instead can be or include vapors, liquids, and/or solids, etc., other than pure air, such as smoke, steam, refrigerant, dust, etc. During warm periods, or high dew point conditions, when air flows across the cooling coil, the air-contacted outer surfaces of the cooling coil can generate and/or cause the formation of condensate (which herein will often be referred to as "water", although the condensate need not be water, and any water need not be pure (e.g., it can contain a refrigerant, volatile organic compounds, dust, and/or debris, etc.)). More particularly, certain exemplary embodiments can form all or part of a condensate drainage system and/or condensate management system that allows removal of water from a condensate-producing unit while simultaneously preventing passage of air through the drain line that extends from the condensate drainage system and/or condensate management system.

Via certain exemplary embodiments, a device, generally referred to herein as an "air-trap", can use pressure generated by an air mover (e.g., fan, blower, etc.) associated with a condensate-producing unit to prevent unwanted airflow in or out of the unit via the condensate drain lines. That is, an air-trap can use air pressure to "trap" and/or substantially prevent unwanted airflow.

Certain exemplary embodiments need not require continually standing water to prevent air from entering and/or leaving a condensate-producing unit via a drain. With the occurrence of condensate within the unit, that condensate can flow out of the unit toward the trap but without escape and/or entry of a substantial quantity/volume/flow of air from/to the unit through the trap. When there is no condensate produced, there can be essentially no liquid remaining in the trap yet there can be substantially no air flowing through the trap to and/or from the unit.

Certain exemplary embodiments, because they do not require water to seal against airflow, can be designed and/or constructed to be less than half the height of a standard P-Trap that is designed to properly manage condensate produced under negative pressure. Yet even that shorter height sometimes can be too great a height to accommodate the location of a trap outside the AC unit because in those scenarios there is not enough height to properly install the trap between (1) where the drain pipe that extends from the condensate-producing unit's case or frame and (2) the ground, roof, or slab or the bottom of the case, frame, and/or curb. Plus, the bottom of the trap generally must be sufficiently high off the ground, roof, or slab to enable the drain line leaving the trap to slope sufficiently to cause condensate to reliably and/or reasonably expeditiously flow through that drain line toward the final drain, such as at a rate/slope of approximately 1 inch of elevation drop for every 8 feet of horizontal length. In many such cases, an installer must lift the condensate-producing unit and place it on a higher curb or rails in order to accommodate the trap. Other solutions to accommodate the trap can include drilling holes in the roof, running piping below the roof, and/or putting the trap inside the building, or putting an electric water pump in the condensate drain pan to pump the condensate to a final drain. The latter can require considerable rework of the system unless it was an integral part of the original design of the condensate producing unit.

FIG. 1 is a block diagram of a condensate-producing unit 1000 that includes a housing and/or plenum 1100 that surrounds a filter 1220, cooling coil 1240, air mover 1260, and/or condensate drain pan 1280. Housing 1100 and/or condensate drain pan 1280 can rest on a frame 1120 and/or directly on a supporting structure 1140, such as a curb, ground, roof, slab, and/or floor.

Air mover 1260 can induce a flow of air from and/or through return air duct 1310 and/or outside air duct 1320, across filter 1220, and/or across and/or through coil 1240, which can cause the formation of condensate 1410 that can drip and/or be directed into condensate drain pan 1280. Air flowing across and/or through coil 1240 (which can be located in and/or on condensate drain pan 1280) can flow into a negatively pressurized inlet 1262 of air mover 1260, which can pressurize the air to a positive pressure P (with respect to an ambient pressure A that can be measured outside and adjacent to housing 1100) release the pressurized air through air mover exit 1264, and/or send positively pressurized air into a supply duct 1330 for distribution as needed for cooling purposes within a building. A small portion of the positively pressurized airflow in supply duct 1330 can be tapped from supply duct 1330 and diverted into a condensate lifter air supply piping 1340, which can flow into lifter inlet piping 1350 (which extends within drain pan 1280), through an interior 1510 of condensate lifter 1500, through lifter outlet piping 1360, and into condensate collector 1600, such as via condensate feed tube 1640. Once entrained condensate 1430 has been substantially removed from air flowing within chamber 1610 of condensate collector 1600, the substantially condensate-free air can exit chamber 1610 via vent 1690, into lifter return duct, conduit, and/or piping 1370 and/or 1380 (which can be located upstream and/or downstream of coil 1240 (so long as upstream of air mover 1260)), and ultimately returned to inlet 1262 of air mover 1260. Note that, assuming modest flowrates and/or flow resistances, air that exits chamber 1610 can be under approximately the same negative pressure N as exists at inlet 1262 of air mover 1260.

Coil 1240 can be located in, extend down into, and/or be supported by and/or above condensate drain pan 1280. Coil-formed condensate 1410 can drip from coil 1240 and/or be directed into condensate drain pan 1280, in which it can accumulate. Pan-accumulated condensate 1420 in condensate drain pan 1280 can enter an inlet port 1520 of condensate lifter 1500 (which can comprise a venturi 1540) and be entrained within interior 1510 as droplets 1430 in the entrainment air flowing through condensate lifter 1500. The entrained droplets 1430 can be carried by the entrainment air from condensate lifter 1500 via lifter outlet piping 1360, and into a volume and/or chamber 1610 defined by a shell 1620 of a condensate collector 1600. While within chamber 1610, the entrained droplets 1430 can spray onto the inner surfaces 1630 of shell 1620, e.g., its top inner surface and/or side inner surface(s). Although not necessarily needed, one or more baffles 1680 can be located within condensate collector 1600, attached to shell 1620, and/or configured to help dis-entrain the entrained droplets 1430 from air flowing through chamber 1610, those baffles having any shape, orientation, and/or pattern that is effective for that dis-entrainment. Within chamber 1610, as entrained droplets 1430 become dis-entrained (no matter what surface (if any) they contact within chamber 1610), their dis-entrained moisture can coalesce into captured drops 1440 that can drip from and/or run down outer wall(s) 1650 of condensate feed tube 1640, the inner surfaces 1630, and/or the baffle(s) 1680, and/or into a variable-volume condensate zone defined within shell 1620, such as an elongated "annular" zone 1660 (i.e., that zone having an annular longitudinal cross-section) defined between inner wall(s) 1630 and outer wall(s) 1650, and the volume of that zone varying with the amount of condensate inside of chamber 1610. Lifted condensate 1450 that accumulates in annular zone 1660 can exit chamber 1610 via chamber drain 1670 and thereby form trapped condensate 1460 that is flow-controlled via first trap 1700 (which can resemble, functionally and/or physically, the traps shown and described in PCT Patent Application WO2018034636 and United States Patent Application Publication 20190226715, each of which is incorporated by reference herein in its entirety). Released condensate 1470 that exits trap 1700 can be routed via drain line 1720 to a drain 1900. In certain exemplary embodiments, when air mover 1260 is not running, residual pan-accumulated condensate 1420 can exit condensate drain pan 1280 via drain pan outlet 1282 as trap-controlled condensate 1480 and flow toward a second trap 1800 (which can resemble, functionally and/or physically, the traps shown and described in PCT Patent Application WO2018034636 and United States Patent Application Publication 20190226715), which can control output trap-released condensate 1490 toward drain 1900.

In situations where there is a negative value N for the pressure differential between the inlet 1262 (low pressure or "negative" side) of air mover 1260 and the ambient pressure value A, which is typical for a draw-through condensate-producing unit 1000, and there is a desire for a condensate trap that is shorter in height than even an air-trap alone, then an air-trap 1700 combined with a condensate lifter 1500 and condensate collector 1600 can allow the entire condensate management system to be contained within the condensate-producing unit 1000 and/or housing 1100, thus removing any traditional height requirement of a trap in order for condensate to flow toward the final drain 1900. That is, a condensate lifter 1500 can be employed to remove condensate from a drain pan 1280 rather than using a trap that requires elevation of the condensate-producing unit 1000, housing 1100, frame 1120, and/or drain pan 1280, and/or lowering of the supporting structure 1140 under the trap.

Certain exemplary embodiments, rather than creating a shorter trap, can allow movement of the effective operating drainage point of the condensate drain pan 1280 (i.e., the chamber drain 1670) to a greater height. This elevation of the effective operating drainage point can be accomplished by applying the kinetic energy created by the positive pressure (having an initial value of P) of the air flowing through a pipe that carries air from air mover outlet 1264 and/or positive side of air mover 1260 (e.g., fan outlet plenum or supply air duct 1330), through a condensate lifter, and to the inlet 1262 and/or negative side of the air mover 1260. The kinetic energy of this flowing air can entrain and raise condensate from drain pan 1280 upward into a chamber 1610 of a condensate collector 1600 that is positioned sufficiently above drain pan 1280 to allow a column of water, which can generate a downward pressure (and/or force) (that pressure typically measured in inches WC), to exist between inlet of trap 1700 and the water level in chamber 1610. That column of water can have an elevation head, shown as dimension H in FIG. 1, that varies as the water level in chamber 1610 changes. Certain exemplary embodiments can utilize a trap 1700 along with the combined water height in the piping, measured from the inlet of trap 1700 to the bottom of the chamber 1610 plus the water level within the annular zone 1660 of chamber 1610, to achieve elevation head H. When elevation head H is greater than the absolute value of the negative pressure N generated by air mover 1260 and pulling upwards on the water in chamber 1610 (i.e., the net elevation head is greater than zero), the ball float of the air-trap can move, be forced, and/or be buoyantly lifted away the seat of the air-trap, thereby allowing the condensate to leave chamber 1610, flow through air-trap 1700, and flow toward drain 1900. Such an embodiment can define the minimum height that a specific condensate lifter embodiment has to raise the water while resulting in maximum condensate flow for that condensate lifter. Use of an air-trap can achieve an elevation head of H, while P-Traps, with respect to air-traps, typically would require an elevation head at least 2×H+2 inches. Again, although air-traps are shown in FIG. 1, P-Traps can be used with a condensate lifter, but doing so can increase the value of H by a factor of 2 or more, which can result in a reduction of condensate flow in the condensate removal system. The piping arrangement to the traps can depend upon whether the drain connection is on the side of the drain pan or in the bottom.

A condensate lifter can address the situation when there is insufficient height outside of the condensate-producing unit and/or its housing to install a condensate trap. To resolve this problem, the condensate lifter can include and/or utilize an air supply pipe that extends within and/or is supported by the drain pan, and then turns upwards to connect to a condensate feed tube within a condensate collector's chamber. Where the air supply pipe extends within the drain pan, at least one injector port, inlet, aperture, and/or hole can exist in that pipe, the injector port allowing condensate to enter into the air supply pipe from the pan. Provided that the resistance to airflow through the injector port and into the drain pan (which might be affected by the height of condensate in the pan) is greater than the resistance for the air to exhaust into the condensate collection chamber, the kinetic energy contained in an airstream generated by the air mover and flowing through the air supply pipe can induce flow of condensate from the drain pan, through the injector port, and into the air supply pipe where that condensate can be entrained in the flowing air. At the injector port, to create a pressure within the air supply pipe that is lower than the pressure in the drain pan, the air supply pipe can have a reduced (longitudinal) cross-sectional area. The reduced cross-sectional area can result in an increase in air velocity across that cross-section, which can result in a static pressure in the cross-section that is lower than the static pressure within the drain pan, thereby causing condensate to flow from the drain pan, through the injector port, and into the air supply pipe. In turn, the flowing air can carry the condensate, in the form of a spray and/or droplets, vertically upward through the inside of the feed tube located within the chamber. The droplets can exit the feed tube into and/or onto the walls, baffles, and/or cap/ceiling of the shell of the condensate collector, that shell having a larger inner diameter than the outer diameter of the feed tube/pipe. The water exiting the feed tube can run down the inner walls of the shell and/or outer walls of the feed tube and/or collect in the elongated annular zone therebetween, while the air can exit the chamber via a vent located, e.g., in the ceiling/cap of the collector, and flow toward the negative/inlet side of the air mover, either directly or via introduction to the return airstream at any point upstream of the air mover that provides sufficient airflow through the condensate lifter to allow the condensate lifter to lift condensate into the condensate collector. Assuming that trap 1700 is an air-trap, when the elevation head H created by the water level within the annular zone combined with the water level in the exit pipe is equal to or greater than N, then that water pressure/head H can be sufficient to force the ball valve of the trap 1700 from its seat and allow condensate to exit the system. Trap 1700, which can be at approximately the same level as the drain pan outlet 1282, need require no additional space below frame 1120, and/or can be located at a point that allows its height to satisfy the approximately ⅛" per foot of slope generally needed to induce gravity-driven flow of condensate through drain line 1720. Trap 1800 can allow condensate residue to exit drain pan 1280 when air mover 1260 shuts down and negative pressure N within drain pan 1280 goes to zero.

Although the location in the air supply piping where the air is flowing by the condensate inlet hole/injector port can be considered to function as a venturi and/or injector, a commercial venturi device need not be used. Instead, the injector port can be sufficiently small that, coupled with the resistance created by any condensate partially and/or fully blocking air from flowing outward through it, its resistance is greater than the resistance the air experiences while flowing from that point in the air supply piping until it exits out of the feed tube and into the condensate collection chamber. For example, if nominal ¾" diameter PVC piping (~1.05" OD, ~0.814 ID) is used as the air supply piping, a diameter of approximately ⅜" can suffice in some scenarios for the condensate injector port. Note that the injector port need not be round nor singular, but instead can be defined by any closed polygon and/or can be defined by any number of ports.

Figure 2:
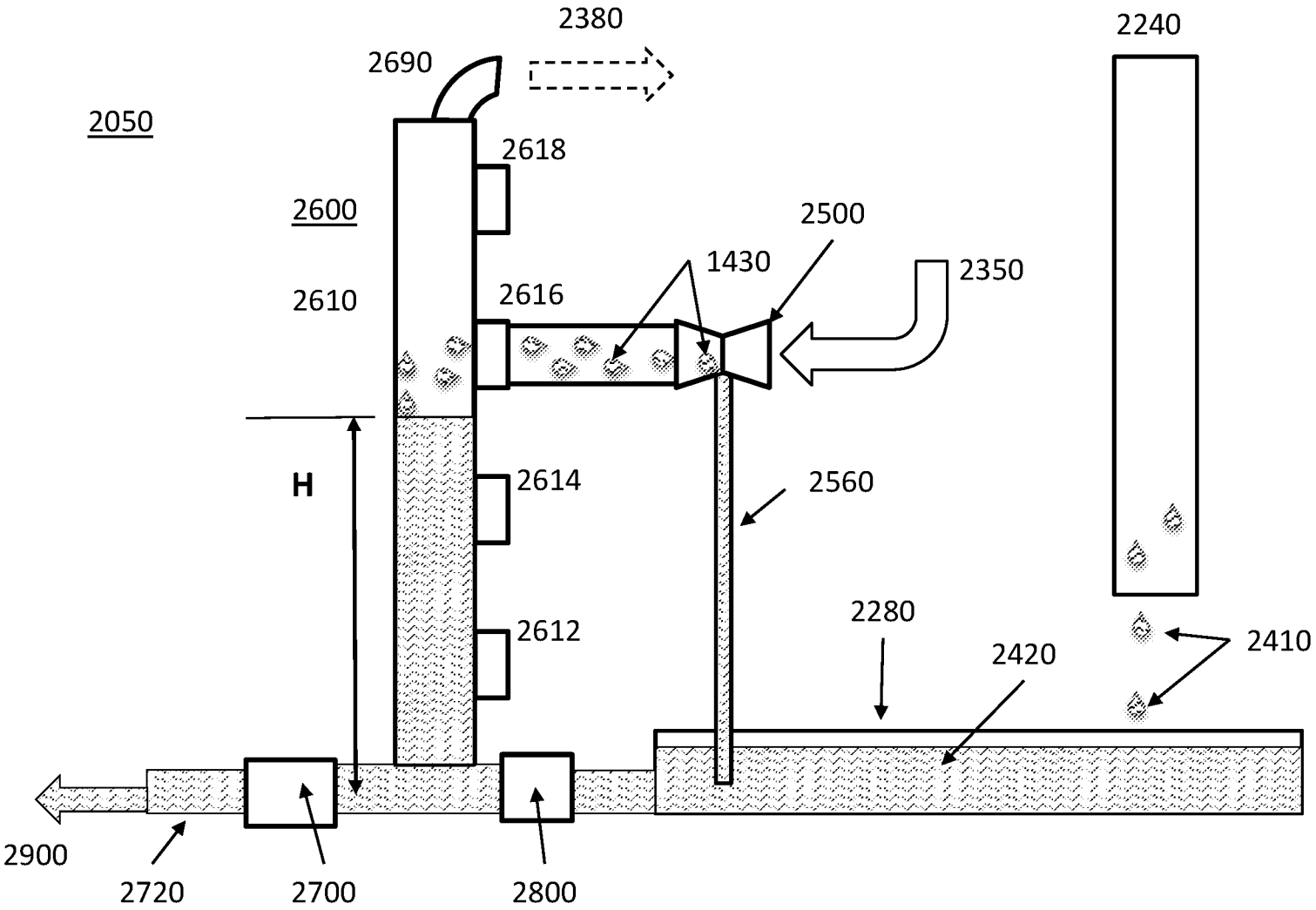
FIG. 2 is a flow diagram of an exemplary embodiment of a system 2000.
Figure 3:
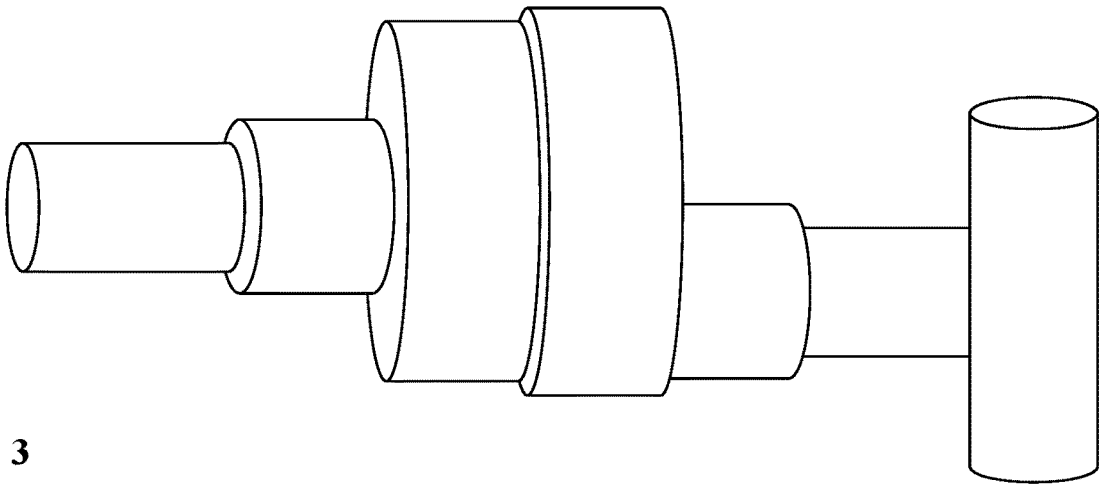
FIG. 3 is a perspective view of an exemplary embodiment of a trap.
Figure 4:
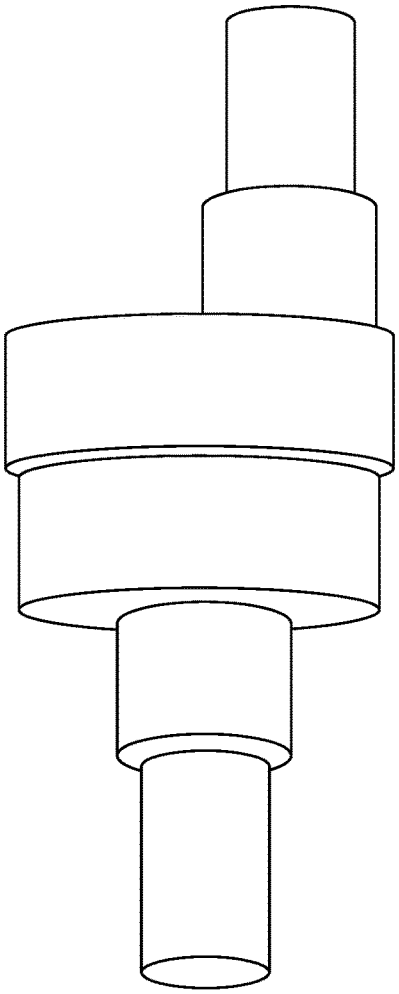
FIG. 4 is a perspective view of an exemplary embodiment of a trap.
Figure 5:
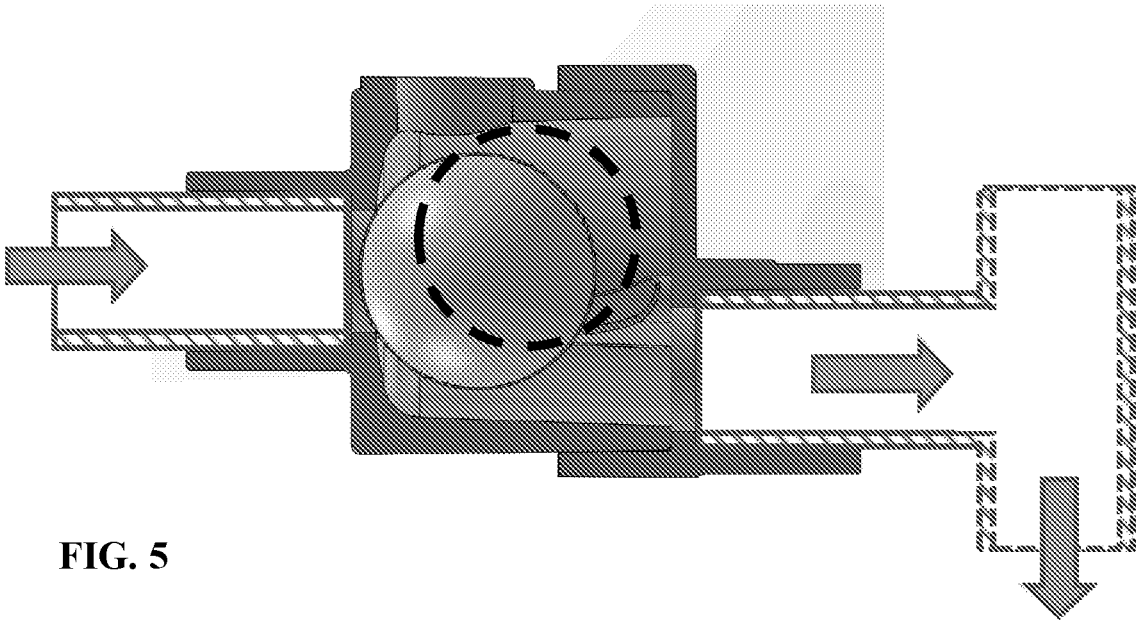
FIG. 5 is a cross-sectional view of an exemplary embodiment of a trap.
Figure 6:
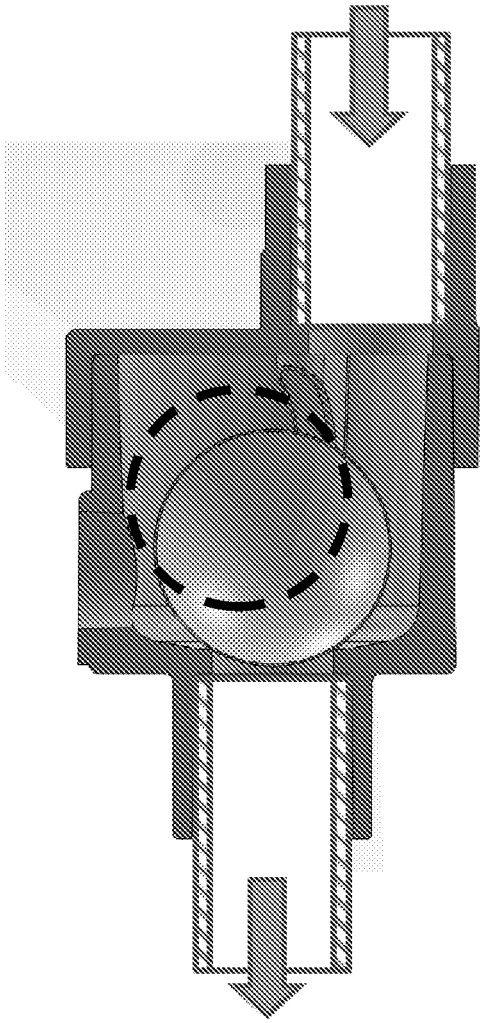
FIG. 6 is a cross-sectional view of an exemplary embodiment of a trap.
Figure 7:
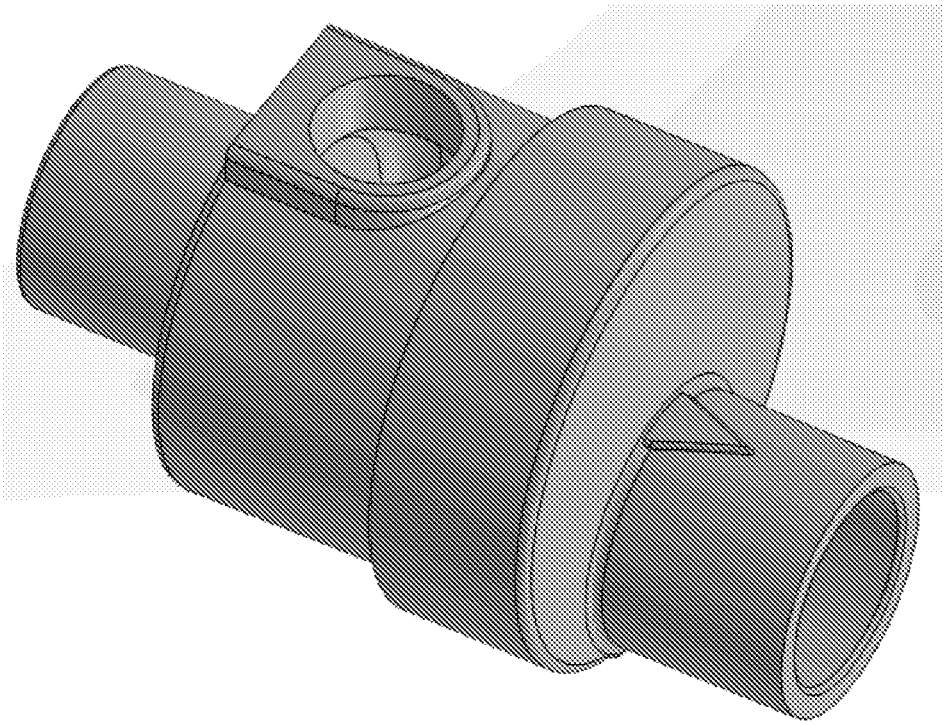
FIG. 7 is a perspective view of an exemplary embodiment of a trap.
Figure 8:
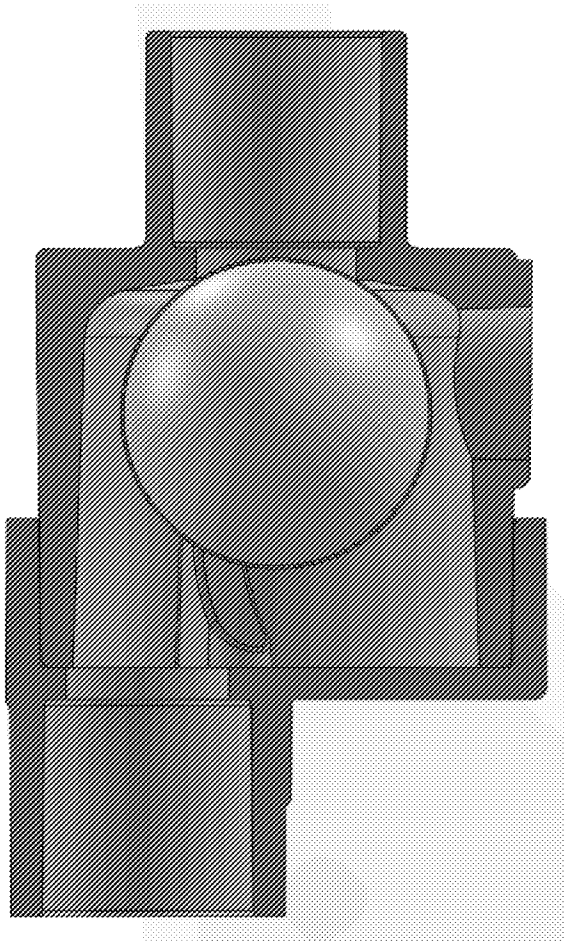
FIG. 8 is a cross-sectional view of an exemplary embodiment of a trap.

FIG. 2 is a block diagram of a condensate management sub-system 2050 of a condensate-producing unit, such as that shown in FIG. 1, with similarly numbered elements (2000 series in FIG. 2 rather than 1000 series in FIG. 1) having generally similar functions unless otherwise stated or contextually apparent.

In sub-system 2050, condensate lifter 2500 can comprise a venturi and/or injector device and/or can be used to urge drain pan condensate 2420, which can drip and/or be directed from coil 2240 into drain pan 2280, to enter airflow 2350 via one or more suction conduits 2560. For example, air flowing from the vicinity of the outlet of the air mover through the air supply piping, through the inlet of a venturi 2500, and toward the vicinity of the inlet of the air mover, can lift condensate 2420 from drain pan 2280 through suction conduit 2560. Within venturi 2500, the lifted condensate can become entrained in the airflow, which can inject the entrained condensate into the, e.g., side and/or top, of condensate collection chamber 2610 of condensate collector 2600. Within chamber 2610, the entrained condensate can become dis-entrained and drip down to become collected condensate, while the entraining airflow can escape chamber 2610 via vent 2690, ultimately returning as return motive air 2380 to the negative side of the condensate-producing unit, such as downstream of the coil and/or in the vicinity of the inlet of the air mover. Chamber 2610, and/or air-traps 2700 and/or 2800 fluidically connected thereto, can be configured to release the condensate in chamber 2610 toward a condensate drain 2900 while substantially preventing air from flowing through the air-trap and into (or from) the drain. Condensate collector 2600 and/or air-traps 2700, 2800 fluidically can be configured to be located inside the unit such that, essentially regardless of the value of N or H, no P-trap is needed, and/or all condensate can be drained from pan 2280 without elevating the unit (or lowering the floor/drain line). That is, the bottom of the drain line 2720 can be located above the bottom of the frame of the unit and above the supporting structure upon which the unit rests without requiring elevation of the unit, such as via installation of a curb.

Note that condensate collector 2600 can be constructed with multiple inlet ports 2612, 2614, 2616, 2618, each of which can be closed/blanked except for the port (e.g., 2616 in FIG. 2) to which the air supply piping is connected, that port selected to correspond approximately to N (i.e., the (negative) normal operating pressure value (in WC) expected above the condensate drain pan).

An exemplary venturi/injector device is the Kymlaa venturi injector, a 1" inch, PVDF, gas-liquid mixing venturi, which is listed by Amazon under their ASIN of B07PK9X3H8 and described as being made of a durable fluoride plastic (PVDF) material that has excellent antichemical, corrosion, anti-oxidation, and/or anti-solvent characteristics, including thermostability up to 298 F. Also stated is that the venturi includes a check valve in the suction conduit of the injector. Another exemplary venturi is the Mazzei venturi fertilizer injector, which is available from DripDepot.com. Although each of these venturis is designed to use water as the working fluid, the inventor has discovered that either venturi can be configured to use air as the working fluid for lifting condensate.

When the cooling coil is located upstream of the air mover and/or the pressure above the condensate drain pan will be negative with respect to ambient, a conduit configured to carry condensate away from the condensate collection chamber can intersect and join with a conduit configured to carry condensate away from the pan. In the drain line formed at and continuing downstream of that intersection can be an air-trap, such as a Des Champs Technologies N series air-trap, that is configured to, while the air mover is operating, substantially prevent air from flowing from the drain and into the condensate chamber and/or the pan.

Downstream of that intersection, in the conduit configured to carry condensate away from the pan, can be an air-trap, such as a Des Champs Technologies P series air-trap, that trap configured so that when the air mover is off, condensate can still drain from the pan.

A venturi can be constructed by forming a simple constriction in a pipe by pressing an appropriately-shaped mandrel into the side of the pipe. The constriction can be made by taking a section of PVC pipe, heated to about 275° F., and forcing the mandrel down onto the pipe until the proper curvature is formed into the pipe. The condensate injector port(s) then can be cut or drilled into the pipe at the point of maximum flow restriction, which is also the point of maximum velocity through the air supply piping, and thereby will induce maximum flow through the injector port(s).

A stand can be configured to support and/or restrain vertical and/or horizontal movement of the condensate collection chamber. The stand in turn can be supported and/or restrained, vertically and/or horizontally, by the drain pan. The stand can be formed from a metal (e.g., aluminum), wood, and/or a polymeric material, such as a molded, stamped, machined, and/or 3D-printed plastic (e.g., PVC, HDPE, ABS, nylon, polycarbonate, etc.).

An alternative embodiment of a condensate lifter can use a small pump to lift condensate from the drain pan into the condensate collection chamber. Such an embodiment can use the air-trap(s) shown in FIG. 1, but need not necessarily use the kinetic energy of air flow between negative and positive pressure sides of the air mover. In certain exemplary embodiments, the required electrical power can be less than 1 amp, as the pump need be required to lift only approximately 1 foot or so of condensate, and thus can be about the size of a small fish tank or fountain pump. That electrical power to energize the pump can be drawn from the power source of the condensate-producing unit's control panel. Such a pump could utilize an on-off switch actuated by one or more water level sensors, such as one or more level switches located in the condensate collection chamber and/or the condensate drain pan. FIGS. 3, 4, 5, 6, 7, and 8 each illustrate a perspective view or a cross-sectional view of an exemplary embodiment of a trap.

Certain exemplary embodiments can provide a system configured to operatively trap air and/or release condensate after operably lifting the condensate from a condensate drain pan located inside a housing of a condensate-producing unit, the condensate drain pan configured to collect condensate from a cooling coil of the condensate-producing unit, an air mover of the condensate-producing unit located fluidically downstream of the cooling coil, the system comprising:

a condensate collector comprising a vented condensate collection chamber located inside the housing of the condensate-producing unit, a bottom of the condensate collection chamber located above a bottom of the condensate drain pan;

a first trap located no lower than a bottom of a frame of the condensate-producing unit;

a condensate lifter located inside a housing of the condensate-producing unit and/or configured to cause condensate to be lifted from the condensate drain pan of the condensate-producing unit and/or into the condensate collection chamber; and/or a second trap configured to allow condensate to exit the system when air mover is not operating and/or the pressure difference is approximately zero;

wherein:

the system is configured to cause the first trap to release condensate from the system only when an elevation head measured between a bottom of an outlet of the first trap and a top of a condensate level in the condensate collection chamber, is greater than or equal to an absolute value of a pressure difference between a pressure measured in air that is in contact with and/or located within 3 inches of a top of a condensate level in the condensate drain pan and a pressure measured in ambient air located outside and/or within 3 inches of the condensate-producing unit;

the condensate lifter is configured to cause droplets of condensate to be entrained in motive air flowing through the condensate lifter and/or toward the condensate collection chamber;

the condensate lifter is configured to cause droplets of condensate to be entrained in motive air flowing through the condensate lifter and/or toward the condensate collection chamber, the motive air pressurized by an air mover of the condensate-producing unit;

the condensate lifter is configured to cause droplets of condensate to be entrained in motive air flowing through the condensate lifter and/or be lifted toward the condensate collection chamber, the motive air flowing through motive air piping that extends across a portion of a floor of the condensate drain pan;

the condensate lifter is configured to cause droplets of condensate to be entrained in motive air flowing through the condensate lifter and/or toward the condensate collection chamber, the condensate lifter comprising a condensate suction tube having an open end located adjacent to a floor of the condensate drain pan;

the condensate lifter is configured to cause condensate in the condensate drain pan to enter the condensate lifter through a suction port of the condensate lifter;

the condensate lifter is configured to cause condensate to be sucked from the condensate drain pan and/or be delivered to the condensate collection chamber;

the condensate lifter is configured to cause condensate to be pumped from the condensate drain pan and be delivered to the condensate collection chamber;

the system is configured to cause a second trap to release condensate from the system only when the air mover is not operating and/or the pressure difference is approximately zero;

the system is configured to allow a bottom of an outlet of the condensate drain pan to be located at a height sufficient to cause gravity-induced draining of the condensate drain pan when the air mover is not operating;

the condensate collection chamber is positioned a sufficient distance above a floor of the condensate drain pan to create the elevation head; air flowing from an outlet of the air mover flows through motive air piping, through the lifter, into the condensate collection chamber, and/or toward an inlet of the air mover;

the condensate collection chamber is configured to substantially prevent lifted condensate from spraying out of the condensate collection chamber;

the first trap allows condensate to flow away from the system when a float of the first trap moves away from a seat of the first trap;

further comprising motive air piping that extends adjacent a portion of a floor of the condensate drain pan, and then turns upwards to connect to a feed tube within the condensate collection chamber;

the condensate collection chamber is configured to substantially prevent droplets that enter the condensate collection chamber from being vented into the housing;

the condensate collection chamber comprising a feed tube and/or a shell, the condensate collection chamber configured to cause droplets of condensate to flow down an outer wall of the feed tube and/or an inner wall of the shell;

the condensate collection chamber defining an annular zone between an outer wall of a feed tube and a side inner surface of a shell of the condensate collection chamber, the annular zone configured to collect condensate that exits the feed tube;

the condensate collector comprising a vent that allows air that enters the condensate collection chamber to exit toward an inlet of the air mover, the condensate collector configured to prevent condensate from being entrained in air that exits the condensate collection chamber;

the first trap comprises a spherical float;

the first trap comprises one or more guide rails attached to or integral with a body of the first trap and/or configured to operably urge a spherical float toward a seat of the first trap when a volume of condensate upstream of the first trap is below a predetermined level; and/or the first trap is configured to substantially prevent air from operatively flowing through the first trap across a seat of the first trap.

Certain exemplary embodiments can provide a condensate-producing unit comprising the system of as described in the immediately preceeding paragraph.

Definitions

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

absolute value—a distance of a number from zero.

accumulate—to amass, collect, gather and/or become gathered together in an increasing quantity.

across—from one side to another.

activity—an action, act, step, and/or process or portion thereof.

adapt—to design, make, set up, arrange, shape, configure, and/or make suitable and/or fit for a specific purpose, function, use, and/or situation.

adapter—a device used to effect operative compatibility between different parts of one or more pieces of an apparatus or system.

adjacent—close to; lying near; next to; adjoining, and/or within a horizontal distance of approximately 0.1 inches to approximately 12 inches, including all values and subranges therebetween.

after—following in time and/or subsequent to.

against—in contact with so as to rest and/or press on, so as to come into forcible contact with, and/or contrary to and/or in a direction and/or course opposite to.

air—the earth's atmospheric gas.

allow—to provide, let do, happen, and/or permit.

along—through, on, beside, over, in line with, and/or parallel to the length and/or direction of; and/or from one end to the other of ambient—pertaining to the status of the enveloping and/or surrounding environment.

amount—a quantity.

an—at least one.

and—in conjuction with.

and/or—either in conjunction with or in alternative to.

annular—shaped like a ring.

any—one, some, every, and/or all without specification.

apparatus—an appliance or device for a particular purpose.

approximately—about and/or nearly the same as.

are—to exist.

around—about, surrounding, and/or on substantially all sides of; and/or approximately.

as long as—if and/or since.

associate—to join, connect together, and/or relate.

at—in, on, and/or near.

at least—not less than, and possibly more than.

atmospheric pressure—the pressure exerted by the earth's atmosphere at any given point, being the product of the mass of the atmospheric column of the unit area above the given point and of the gravitational acceleration at the given point; typically approximately 14.7 psia.

attach—to fasten, secure, couple, and/or join.

attached—joined or secured together.

away—on a path directed from a predetermined location.

axis—a straight line about which a body and/or geometric object rotates and/or can be conceived to rotate and/or a center line to which parts of a structure and/or body can be referred.

back—that portion and/or side that is opposite and/or behind the front.

ball—a substantially spherical object.

based on—indicating one or more factors that affect a determination, but not necessarily foreclosing additional factors that might affect that determination.

be—to exist in actuality.
below—beneath; in a lower place; and/or less than.
between—in a separating interval and/or intermediate to.
bias—n. a tension and/or force; v. to urge and/or force.
block—(n) an obstacle and/or the act of blocking; (v) to obstruct, stop and/or or impede the passage of and/or movement through; obstruct, and/or to prevent from happening, succeeding, and/or progressing.
body—a main and/or central part.
bottom—a lowest part of an object relative to a point of reference, the object in a predetermined orientation relative to the point of reference.
bottom—opposite of top and/or a lowest part of an object relative to a point of reference, the object in a predetermined orientation relative to the point of reference.
buoyancy—the ability to float in a liquid and/or to rise in a fluid; and/or the upward force that a fluid exerts on an object less dense than itself that is at least partly immersed in the fluid.
buoyant—having and/or marked by buoyancy.
by—via and/or with the use and/or help of
can—is capable of, in at least some embodiments.
cause—to bring about, provoke, precipitate, produce, elicit, be the reason for, result in, and/or effect.
cease—to halt and/or stop.
central—situated at, in, or near the center of a length.
centroid—the "centroid" or geometric center of a plane figure is the arithmetic mean position of all the points in the figure. The "centroid" of a ring or a bowl, for example, lies in the object's central void.
chamber—a space and/or compartment that is substantially or at least partially defined and surrounded by one or more objects.
chamber—an enclosed space, reservoir, and/or compartment.
chamber-facing—having a surface that defines, is in contact with, and/or is adjacent to a chamber.
circular—having a cross-section of a circle and/or substantially resembling a round shape.
clean-out—an access for inspecting, reaching, and/or removing obstructions, debris, and/or contaminants; and/or a pipe fitting containing a removable plug that provides access for inspection and/or cleaning of the pipe run.
closable—able to be repeatedly closed.
close—to alter and/or move an object so that an opening and/or or passage is covered and/or obstructed by the object; to shut; and/or to draw and/or bind together.
coaxial—having and/or mounted on a common axis.
coil—a heat exchanger.
collect—to gather, accumulate, and/or bring together in a group or mass.
collection—an accumulation and/or the act or process of collecting.
combustion—the chemical action resulting from the direct combination of oxygen gas, generally in air, with a combustible material accompanied by the evolution of heat and light.
composition of matter—a combination, reaction product, compound, mixture, formulation, material, and/or composite formed by a human and/or automation from two or more substances and/or elements.
comprising—including but not limited to, what follows.
conceive—to imagine, conceptualize, form, and/or develop in the mind.
condensate—the liquid resulting from condensation of a gas, such as an aqueous solution that condenses from a furnace combustion gas.
conduit—a tube, channel, and/or duct for substantially enclosing electric wires and/or cable.
configure—to design, arrange, set up, shape, and/or make suitable and/or fit for a specific purpose, function, use, and/or situation.
configured to—having a structure that, during operation, will perform the indicated activity(ies). To the extent relevant to the current application, the use of "configured to" is expressly not intended to invoke 35 U.S.C. § 112(f) for that structure.
connect—to physically join, link, couple, and/or fasten two or more entities.
contact—to physically touch and/or come together.
contain—to store, restrain, hold, and/or keep within limits.
containment—the act of containing, keeping from spreading, and/or directing the flow, motion, and/or spread of.
convert—to transform, adapt, and/or change.
convex—having a surface and/or boundary that curves and/or bulges outward, as the exterior of a sphere; and/or a surface such that for any pair of points on the surface, any point on the straight line segment that joins the pair of points is under the object.
convey—to transmit, transport, guide, and/or carry.
cooling—reducing a temperature of a substance.
corresponding—related, associated, accompanying, similar in purpose and/or position, conforming in every respect, and/or equivalent and/or agreeing in amount, quantity, magnitude, quality, and/or degree.
coupleable—capable of being joined, connected, and/or linked together.
coupling—linking in some fashion.
create—to make, form, produce, generate, bring into being, and/or cause to exist.
debris—a solid substance and/or the remains of something destroyed, disintegrated, and/or decayed.
define—to establish the meaning, relationship, outline, form, and/or structure of; and/or to precisely and/or distinctly describe and/or specify.
deliver—to give forth, transfer, and/or produce.
deter—to hamper, hinder, delay, interrupt, interfere, oppose, restrict, retard, impede, stop, and/or prevent from doing, acting, happening, and/or progressing.
determine—to find out, obtain, calculate, decide, deduce, ascertain, and/or come to a decision, typically by investigation, reasoning, and/or calculation.
device—a machine, manufacture, and/or collection thereof.
difference—a value obtained via a subtraction of a first quantity from a second quantity.
direct—to point, aim, control, cause, provide instruction to, send toward a place and/or object, and/or cause to move in or follow a predetermined course.
direction—a spatial relation between something and a course along which it points and/or moves; a distance independent relationship between two points in space that specifies the position of either with respect to the other; and/or a relationship by which the alignment and/or orientation of any position with respect to any other position is established.
disconnect—to unattach and/or sever a connection.
distance—a measure of physical and/or logical separation.
down—in a vertically decreasing direction.

downstream—with and/or in a direction of flow of an electrical current.

drain—(n) a pipe and/or channel that carries off water, liquid, slurry, waste, sewage, etc.; (v) to empty, cause liquid to go out from, draw off (a liquid) by a gradual process, and/or become empty by the drawing off of liquid.

droplet—a tiny drop.

each—every one of a group considered individually.

effective—sufficient to bring about, provoke, elicit, and/or cause.

elevation head—also called "head" herein, the gauge pressure created at the bottom of a column of water due to the weight of that water (i.e., due to the force of gravity operating on that column).

ellipsoid—a geometric surface, all of whose plane sections are either ellipses or circles; and/or a solid having such a shape.

elongated—drawn out, made spatially longer, and/or having more length than width.

embodiment—an implementation, manifestation, and/or concrete representation.

end—an extremity and its vicinity of something that has length; a terminus.

enter—to come and/or flow into.

entrain—to carry (suspended droplets, for example) along in a current of, e.g., gas and/or air.

equal—substantially the same as.

estimate—(n) a calculated value approximating an actual value; (v) to calculate and/or determine approximately and/or tentatively.

exemplary—serving as an example, instance, and/or illustration.

exit—(n) a path, passage, and/or way leading through an opening and away from an interior of a container; (v) to leave, go away, and/or flow out of.

extend—to reach spatially outward and/or to run between two points and/or beyond a certain point.

exterior—a region that is outside of a device and/or system.

extrude—to shape (a plastic, for instance) by forcing it through a die.

feed—an inlet and/or that which delivers and/or provides a fluid.

first—a label for a referenced element in one or more patent claims, but that label does not necessarily imply any type of ordering to how that element (or any other elements of a similar type) is implemented in embodiments of the claimed subject matter.

first—an initial cited element of a set.

float—(n) a buoyant object; (v) to cause to and/or to remain suspended within and/or on the surface of a fluid without sinking.

floor—a supporting and/or bottom surface of a structure.

flow—(n) the act of flowing, a continuous transfer, and/or a stream and/or current; (v) to pour forth, issue in a stream, and/or move and/or run smoothly with unbroken continuity, as in the manner characteristic of a fluid.

flow—to move and/or run substantially smoothly with substantially unbroken continuity, as in the manner characteristic of a fluid; to issue in a stream; and/or to pour forth.

flowrate—a measure how much flows over a given time period.

fluid—a liquid, slurry, vapor, mist, cloud, plume, and/or foam, etc.

fluidic—of, relating to, or characteristic of a fluid.

for—with a purpose of.

force—a capacity to do work and/or cause physical change.

form—(v) to construct, build, generate, and/or create; (n) a phase, structure, and/or appearance.

fourth—a label for an element in one or more patent claims, the element other than a "first" or "second" or "third" referenced element of a similar type, but the label does not necessarily imply any type of ordering to how that "fourth" element is implemented in embodiments of the claimed subject matter.

frame—a structure adapted to support and/or contain something.

from—used to indicate a source, origin, and/or location thereof.

front—that portion and/or side that is forward, prominent, and/or most often seen and/or used.

function—to perform as designed when applied.

furnace—a chamber, enclosure, or other holding means for heating materials therein.

further—in addition.

gas—a substance in a gaseous state, that is, in a state of matter distinguished from the solid and liquid states by relatively low density and viscosity, relatively great expansion and contraction with changes in pressure and temperature, the ability to diffuse readily, and the spontaneous tendency to become distributed uniformly throughout any container.

generate—to create, produce, give rise to, and/or bring into existence.

given— gravity-induced—effected by the force of gravity.

greater—comparatively higher in magnitude.

guide—to direct, steer, and/or exert control and/or influence over; and/or a passive structure configured to direct, resist, and/or prevent the movement of something.

having—possessing, characterized by, comprising, and/or including, but not limited to.

height—a distance from a point at a given level to a point at a different level.

horizontal—parallel to and/or in the plane of the horizon.

including—including but not limited to.

initialize—to prepare something for use and/or some future event.

inlet—an opening providing a means of entrance and/or intake.

inner—closer than another to the center and/or middle.

inside—within a predetermined boundary.

install—to connect or set in position and prepare for use.

integral—formed and/or united into another entity.

intersecting—meeting at a point and/or cutting across and/or through.

into—toward, in the direction of, and/or to the inside of.

is—to exist in actuality.

left—opposite of right and/or of and/or designating the side of something and/or someone that faces west when the front is turned towards the north.

length—a longest dimension of something and/or the measurement of the extent of something along its greatest dimension.

less than—having a measurably smaller magnitude and/or degree as compared to something else.

level—an amount, a relative position on a scale, and/or a position along a vertical axis indicating height and/or depth.

lift—(v) to raise and/or to direct and/or carry from a lower to a higher position.
lifter—that which is configured to lift.
located—situated approximately in a particular spot and/or position.
longitudinal axis—a straight line defined parallel to an object's length and passing through a centroid of the object.
lower—in a position below something else and/or lesser in elevation in relation to something else and/or lesser in magnitude in relation to something else.
mating—one of a matched pair.
may—is allowed and/or permitted to, in at least some embodiments.
measured—determined, as a dimension, quantification, and/or capacity, etc. by observation.
method—one or more acts that are performed upon subject matter to be transformed to a different state or thing and/or are tied to a particular apparatus, said one or more acts not a fundamental principal and not preempting all uses of a fundamental principal.
more—a quantifier meaning greater in size, amount, extent, and/or degree.
move—to change a position and/or place.
moving—transferring from one location to another.
near—a distance of less than approximately [X].
negative—less than zero and/or at a pressure less than atmospheric.
no—an absence of and/or lacking any.
non-destructively—of, relating to, or being a process that does not result in damage to the subject material and/or product and/or results in such minimal damage that the subject material and/or product can be re-used for its intended purpose.
not—a negation of something.
one—being and/or amounting to a single unit, individual, and/or entire thing, item, and/or object.
only—substantially without anything else.
open—(v) to interrupt, to release from a closed and/or fastened position, to remove obstructions from, to clear; (adj) not substantially obstructed and/or not closed.
openable—able to be opened.
opening—an open space serving as an aperture, passage, or gap.
operable—practicable and/or fit, ready, and/or configured to be put into its intended use and/or service.
operably—when operating and/or in effect for its intended use and/or service.
operating—arising out of normal and/or functional operations of an entity.
operation—a series of actions in performing a function; and/or when operating and/or in effect for its intended use and/or service.
operative—when in operation for its intended use and/or service.
or—a conjunction used to indicate alternatives, typically appearing only before the last item in a group of alternative items.
orient—to position a first object relative to a second object.
orthogonal—perpendicular and/or at a right angle to.
other—a different and/or distinct entity and/or not the same as already mentioned and/or implied.
out—in a direction away from the inside, center, and/or middle, such as a container and/or source.
outer—farther than another from the center and/or middle.
outlet—a passage configured to allow exit of condensate and/or a point where a flow of condensate is controlled, restricted, and/or prevented.
outside—beyond a range, boundary, and/or limit; and/or not within.
overall—total, combined, and/or cumulative effect.
pan—a shallow, wide, open container, usually of metal and without a lid, used for holding liquids.
part—a component.
passes—runs and/or extends.
per—for each and/or by means of.
pipe—a hollow cylinder and/or tube used to conduct a liquid, gas, and/or finely divided solid.
piping—pipes collectively, especially pipes formed into a fluidically-connected system, as in the plumbing of a building.
pivot—(v) to rotate, revolve, and/or turn; (n) the act of turning on a pivot and/or a short rod or shaft on which a related part rotates and/or or swings.
plenum—an enclosed space in which, under normal operating conditions, the pressure of the contained gas is other than that outside the enclosed space.
plurality—the state of being plural and/or more than one.
port—an opening for the insertion and/or passage of an object and/or fluid.
portion—a part, component, section, percentage, ratio, and/or quantity that is less than a larger whole.
position—to put in place or position.
positive—greater than zero and/or at a pressure greater than atmospheric.
pre-—a prefix that precedes an activity that has occurred beforehand and/or in advance.
predetermine—to determine, decide, and/or establish in advance.
present—existing.
pressure—a measure of force applied uniformly over a surface.
pressurize—to put (gas and/or liquid) under a greater than normal pressure
prevent—to impede, resist, hinder, avert, deter, stop, and/or keep from happening.
prevent—to impede, resist, hinder, stop, and/or keep from happening.
prior—before and/or preceding in time or order.
probability—a quantitative representation of a likelihood of an occurrence.
produce—to create, generate, manufacture, bring forth, and/or cause to exist.
product—something produced by human and/or mechanical effort.
project—to calculate, estimate, or predict.
provide—to furnish, supply, give, and/or make available.
rail—a guide, running surface, bar, and/or member configured for supporting and/or guiding another thing.
range—a measure of an extent of a set of values and/or an amount and/or extent of variation.
ratio—a relationship between two quantities expressed as a quotient of one divided by the other.
receive—to gather, take, acquire, obtain, accept, get, and/or have bestowed upon.
recommend—to suggest, praise, commend, and/or endorse.
reduce—to make and/or become lesser and/or smaller.
relative—considered with reference to and/or in comparison to something else.

release—to let go and/or free from something that restrains, binds, fastens, and/or holds back.

remain—to continue to be in the same place; to stay or stay behind;

and/or to be left after the removal, loss, passage, or destruction of other.

remove—to eliminate, remove, and/or delete, and/or to move from a place or position occupied.

repeat—to do again and/or perform again.

repeatedly—again and again; repetitively.

request—to express a desire for and/or ask for.

result—(n.) an outcome and/or consequence of a particular action, operation, and/or course; (v.) to cause an outcome and/or consequence of a particular action, operation, and/or course.

retain—to restrain, keep, and/or hold.

right—opposite of left and/or of and/or designating the side of something and/or someone that faces east when the front is turned towards the north.

rightward—toward the right.

ring—a substantially toroidal object which can be imagined as having been generated by rotating a closed loop (e.g., ellipse, circle, irregular curve, polygon, etc.) about a fixed line external to the loop.

rotational—about and/or around an axis.

said—when used in a system or device claim, an article indicating a subsequent claim term that has been previously introduced.

seal—(v.) to shut close; to keep close; to make fast; to keep secure; to prevent leakage; (n.) a device configured to shut close; to keep close; to make fast; to keep secure; and/or to prevent leakage.

seat—(n) a sealing, supporting, and/or mating surface; (v) to attach to, seal against, support with, and/or bring firmly into contact with.

second—a label for an element in one or more patent claims, the element other than a "first" referenced element of a similar type, but the label does not necessarily imply any type of ordering to how that "second" element or the "first" element is implemented in embodiments of the claimed subject matter.

segment—all co-linear points located between and including two points.

select—to make a choice or selection from alternatives.

set—a related plurality.

shape—a characteristic surface, outline, and/or contour of an entity.

shell—a hard external protective case or cover.

side—a surface of an object, especially a surface joining a top and bottom.

slope—(v) to position at an angle and/or incline with respect to vertical or horizontal; (n) an inclined line, surface, plane, position, and/or direction; and/or with respect to a first point and a second point that are intersected by a straight line, a ratio of the change in the ordinal value from the first point to the second point, to the change in the abscissal value from the first point to the second point; and/or a measure of a degree of inclination; and/or a rate of change.

smooth—lacking substantial surface irregularities, roughness, and/or projections.

source—a point and/or thing at or from which something originates, springs into being, and/or from which it derives and/or is obtained.

space—an area, gap, and/or volume.

species—a class of individuals and/or objects grouped by virtue of their common attributes and assigned a common name; a division subordinate to a genus.

spherical—having the shape of, or substantially resembling, a sphere.

spray—to disperse (a liquid, for example) in a mass and/or a jet of droplets.

stationary—substantially fixed with respect to an object of reference.

stop—(n) a device and/or means that obstructs, blocks, deters, and/or plugs up; (v) to interrupt, cease and/or end, and/or to block and/or prevent the flow or passage of store—to place, hold, and/or retain data, typically in a memory.

stream—a flow of water and/or other fluid substantially—to a considerable, large, and/or great, but not necessarily whole and/or entire, extent and/or degree.

such that—in a manner that results in.

suck—to induce flow via suction.

suction—(n) an act and/or force that reduces the pressure in a space, causing a fluid and/or solid to flow into it from a region of greater pressure.

suction port—an opening configured for induced entry of a first fluid into a flow of a motive fluid via a device employing the Bernoulli effect.

sufficient—a degree and/or amount necessary to achieve a predetermined result.

support—to bear the weight of, especially from below.

surface—an outer boundary of a body, object, and/or thing and/or any material layer and/or face constituting and/or resembling such a boundary.

system—a collection of mechanisms, devices, machines, articles of manufacture, processes, data, and/or instructions, the collection designed to perform one or more specific functions.

that—used as the subject or object of a relative clause.

then—immediately afterward and/or next in time, space, and/or order.

therein—within.

third—a label for an element in one or more patent claims, the element other than a "first" or "second" referenced element of a similar type, but the label does not necessarily imply any type of ordering to how that "third" element is implemented in embodiments of the claimed subject matter.

through—across, among, between, and/or in one side and out the opposite and/or another side of to—a preposition adapted for use for expressing purpose.

toward—used to indicate a destination and/or in a physical and/or logical direction of.

transform—to change in measurable: form, appearance, nature, and/or character.

transmit—to send as a signal, provide, furnish, and/or supply.

trap—(n) a device configured for sealing a passage against the escape of gases; (v) to seal off and/or prevent flow of treatment—an act, manner, or method of handling and/or dealing with someone and/or something.

tube—an elongate member having a longitudinal axis and defining a longitudinal cross-section resembling any substantially closed shape such as, for example, a circle, a non-circle such as an oval (which generally can include a shape that is substantially in the form of an obround, ellipse, limaçon, cardioid, cartesian oval, and/ or Cassini oval, etc.), and/or a polygon such as a triangle, rectangle, square, parallelogram, rhomboid, pentagon, hexagon, the shape of the letter "D", the shape of the letter "P", etc. Thus, a right circular cylinder is one form of a tube, an elliptic cylinder is another form of a tube having an elliptical longitudinal cross-section, and a generalized cylinder is yet another form of a tube.

turn—to change the position of by traversing an arc.

two—a cardinal number equal to one plus one.

unit—something that has separate and distinct existence.

unitary—whole, not separated, and/or having the nature of a unit.

upon—immediately or very soon after; and/or on the occasion of.

upper—in a high position relative to something else.

upward—toward and/or facing up and/or a top.

urge—to bias, encourage, stimulate, excite, move, impel, force, and/or drive.

use—to put into service.

vector—an expression characterized by a magnitude and a direction.

vent—(n) an opening configured to permit the escape of fumes, air, a gas, and/or steam; (v) to release from confinement.

vertical—substantially perpendicular to horizontal.

head—vertical expanse of water lying between an area on the upper surface of a body of water and a lower surface of the body of water.

via—by way of, with, and/or utilizing.

volume—a mass and/or a three-dimensional region that an object and/or substance occupies.

wall—a partition, structure, and/or mass that serves to enclose, divide, separate, segregate, define, and/or protect a volume and/or to support a floor, ceiling, and/or another wall.

water—a transparent, odorless, tasteless liquid containing approximately 11.188 percent hydrogen and approximately 88.812 percent oxygen, by weight, characterized by the chemical formula H2O, and, at standard pressure (approximately 14.7 psia), freezing at approximately 32° F. or OC and boiling at approximately 212° F. or 100 C.

water column—a unit of measure of pressure whereby 1 psi is equivalent to 27.71 inches of water column or WC, such that 1 inch of water column is the amount of force required to raise the column of water by 1 inch; a weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.

when—at a time and/or during the time at which.

wherein—in regard to which; and; and/or in addition to.

while—for as long as, during the time that, and/or at the same time that.

width—a measurement of the extent of something along an, often substantially horizontal, dimension.

with—accompanied by.

with regard to—about, regarding, relative to, and/or in relation to.

with respect to—about, regarding, relative to, and/or in relation to.

within—inside the limits of.

without—not accompanied by.

zero—none and/or at a point of origin of a coordinate system.

zone—a region and/or volume having at least one predetermined boundary.

Note

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. References herein to "in one embodiment", "in an embodiment", or the like do not necessarily refer to the same embodiment.

Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects any person having ordinary skill in the art, after obtaining authorization from the inventor(s), to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly unsuitable, inoperable, or contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

there is no requirement for the inclusion of any particular described characteristic, function, activity, substance, or structural element, for any particular sequence of activities, for any particular combination of substances, or for any particular interrelationship of elements;

no described characteristic, function, activity, substance, or structural element is "essential"; and within, among, and between any described embodiments:

any two or more described substances can be mixed, combined, reacted, separated, and/or segregated;

any described characteristic, function, activity, substance, component, and/or structural element, or any combination thereof, can be specifically included, duplicated, excluded, combined, reordered, reconfigured, integrated, and/or segregated;

any described interrelationship, sequence, and/or dependence between any described characteristics, functions, activities, substances, components, and/or structural elements can be omitted, changed, varied, and/or reordered;

any described activity can be performed manually, semi-automatically, and/or automatically;

any described activity can be repeated, performed by multiple entities, and/or performed in multiple jurisdictions.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all sub-ranges therebetween, such as for example, 1 to 3.65, 2.8 to 8.14, 1.93 to 9, etc., even if those specific values or specific sub-ranges are not explicitly stated.

When any phrase (i.e., one or more words) appearing in a claim is followed by a drawing element number, that drawing element number is exemplary and non-limiting on claim scope.

No claim or claim element of this document is intended to invoke 35 USC 112(f) unless the precise phrase "means for" is followed by a gerund.

Any information in any material (e.g., a United States patent, United States patent application, book, article, web page, etc.) that has been incorporated by reference herein, is incorporated by reference herein in its entirety to its fullest enabling extent permitted by law yet only to the extent that no conflict exists between such information and the other definitions, statements, and/or drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Applicant intends that each claim presented herein and at any point during the prosecution of this application, and in any application that claims priority hereto, defines a distinct patentable invention and that the scope of that invention must change commensurately if and as the scope of that claim changes during its prosecution. Thus, within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document when reasonably interpreted by a person having ordinary skill in the relevant art.

What is claimed is:

1. A condensate management system configured to operatively trap air and release condensate after operably lifting the condensate from a condensate drain pan located inside a housing of a condensate-producing unit, the condensate drain pan configured to collect condensate from a cooling coil of the condensate-producing unit, an air mover of the condensate-producing unit located fluidically downstream of the cooling coil, the system comprising:

a condensate collector comprising a vented condensate collection chamber located inside the housing of the condensate-producing unit, a bottom of the condensate collection chamber located above a bottom of the condensate drain pan;

a first trap located no lower than a bottom of a frame of the condensate-producing unit; and a condensate lifter that is located inside the housing of the condensate-producing unit and comprises a venturi configured to apply kinetic energy of air flow generated by the air mover to lift condensate from the condensate drain pan of the condensate-producing unit and into the condensate collection chamber;

wherein:

the system is configured to cause the first trap to release condensate from the system only when an elevation head, measured between a bottom of an outlet of the first trap and a top of a condensate level in the condensate collection chamber, is greater than or equal to an absolute value of a pressure difference between a pressure measured in air that is in contact with and located within 3 inches of a top of a condensate level in the condensate drain pan and a pressure measured in ambient air located outside and within 3 inches of the condensate-producing unit.

2. The system of claim 1, further comprising:

a second trap configured to allow condensate to exit the system when the air mover is not operating and the pressure difference is zero.

3. The system of claim 1, wherein:

the condensate lifter is configured to cause droplets of condensate to be entrained in motive air flowing through the condensate lifter and toward the condensate collection chamber.

4. The system of claim 1, wherein:

the condensate lifter is configured to cause droplets of condensate to be entrained in motive air flowing through the condensate lifter and toward the condensate collection chamber, the motive air pressurized by the air mover of the condensate-producing unit.

5. The system of claim 1, wherein:

the condensate lifter is configured to cause droplets of condensate to be entrained in motive air flowing through the condensate lifter and toward the condensate collection chamber, the condensate lifter comprising a condensate suction tube having an open end located adjacent to a floor of the condensate drain pan.

6. The system of claim 1, wherein:

the condensate lifter is configured to cause condensate in the condensate drain pan to enter the condensate lifter through a suction port of the condensate lifter.

7. The system of claim 1, wherein:

the condensate lifter is configured to cause condensate to be sucked from the condensate drain pan and delivered to the condensate collection chamber.

8. The system of claim 1, wherein:

the system is configured to cause a second trap, located fluidically upstream from the first trap, to release condensate from the system only when the air mover is not operating and the pressure difference is zero.

9. The system of claim 1, wherein:

the system is configured to allow a bottom of an outlet of the condensate drain pan to be located at a height sufficient to cause gravity-induced draining of the condensate drain pan when the air mover is not operating.

10. The system of claim 1, wherein:

the condensate collection chamber is positioned a predetermined distance above a floor of the condensate drain pan to create the elevation head.

11. The system of claim 1, wherein:

air flowing from an outlet of the air mover flows through motive air piping, through the lifter, into the condensate collection chamber, and toward an inlet of the air mover.

12. The system of claim 1, wherein:

the condensate collection chamber is configured to substantially prevent lifted condensate from spraying out of the condensate collection chamber.

13. The system of claim 1, wherein:

the first trap allows condensate to flow away from the system when a float of the first trap moves away from a seat of the first trap.

14. The system of claim 1, wherein:

the condensate collection chamber is configured to prevent droplets that enter the condensate collection chamber from being vented into the housing.

15. The system of claim 1, wherein:

the condensate collector comprises a vent that allows air that enters the condensate collection chamber to exit toward an inlet of the air mover, the condensate collector configured to prevent condensate from being entrained in air that exits the condensate collection chamber.

16. The system of claim 1, wherein:

the first trap comprises a spherical float.

17. The system of claim 1, wherein:

the first trap comprises one or more guide rails attached to or integral with a body of the first trap and configured to operably urge a spherical float toward a seat of the first trap when a volume of condensate upstream of the first trap is below a predetermined level.

18. The system of claim 1, wherein:

the first trap is configured to prevent air from operatively flowing through the first trap across a seat of the first trap.

19. A heating, ventilating, air conditioning, ice-making, and/or dehumidifying system comprising the condensate management system of claim 1.

* * * * *